US008620178B2

(12) United States Patent
Jun et al.

(10) Patent No.: US 8,620,178 B2
(45) Date of Patent: Dec. 31, 2013

(54) DEVELOPING CARTRIDGE AND IMAGE FORMING APPARATUS EMPLOYING THE SAME

(75) Inventors: Jong-pil Jun, Hwaseong-si (KR); Yong-sung Kim, Seongnam-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 207 days.

(21) Appl. No.: 13/081,828

(22) Filed: Apr. 7, 2011

(65) Prior Publication Data

US 2012/0063805 A1 Mar. 15, 2012

(30) Foreign Application Priority Data

Sep. 10, 2010 (KR) ..... 10-2010-0089071

(51) Int. Cl.
*G03G 15/08* (2006.01)

(52) U.S. Cl.
USPC ..... 399/103; 399/105

(58) Field of Classification Search
USPC ..... 399/103–106
See application file for complete search history.

(56) References Cited

U.S. PATENT DOCUMENTS 4,592,653 A * 6/1986 Ikeda et al. ..... 399/103
5,424,814 A * 6/1995 Suzuki et al. ..... 399/284
5,488,462 A * 1/1996 Ishikawa et al. ..... 399/103
5,749,026 A * 5/1998 Goldie ..... 399/103
2008/0167633 A1* 7/2008 Vannucci ..... 604/306

FOREIGN PATENT DOCUMENTS

JP 06-075463 A * 3/1994
JP 06075463 A * 3/1994 ..... G03G 15/08

* cited by examiner

*Primary Examiner* — Clayton E Laballe
*Assistant Examiner* — Jas Sanghera
(74) *Attorney, Agent, or Firm* — Staas & Halsey LLP

(57) ABSTRACT

A developing cartridge and an image forming apparatus employing the same which include a developer sealing configuration to prevent a developer in a developing chamber of the developing cartridge from leaking during a distribution process are disclosed. The developing cartridge of an image forming apparatus, the developing cartridge including: a developing housing which accommodates therein a developer and includes an opening through which the developer is supplied to the outside; an image carrier which is mounted in the developing housing; a developing roller which is mounted in the opening of the developing housing to face the image carrier and develops an image on the image carrier; and a sealing member which includes a sealing part partially provided between the image carrier and the developing roller in a sealing location and sealing the opening and a grip part extended from the sealing part to an outside of the developing housing.

22 Claims, 9 Drawing Sheets

DEVELOPING CARTRIDGE AND IMAGE FORMING APPARATUS EMPLOYING THE SAME

CROSS-REFERENCE TO RELATED APPLICATION

This application claims benefit priority from Korean Patent Application No. 10-2010-0089071, filed on Sep. 10, 2010 in the Korean Intellectual Property Office, the disclosure of which is incorporated herein by reference.

BACKGROUND

1. Field

Apparatuses and methods consistent with the exemplary embodiments relate to a developing cartridge and an image forming apparatus employing the same, and more particularly, to a developing cartridge and an image forming apparatus employing the same which includes a developer sealing configuration to prevent a developer in a developing chamber of the developing cartridge from leaking during a distribution process.

2. Description of the Related Art

An image forming apparatus such as a printer, a photocopier, a facsimile and a multi-function device forms an image on a print medium by electrophotographic, inkjet and thermal transfer methods. Among those types, the electrophotographic image forming apparatus includes a developing cartridge which has a developer inside the developing chamber.

To identify any defect during a manufacturing process, the developing cartridge should undergo a test print. According the result of the test print, the qualified developing cartridge is packed and released in the market.

If the developing cartridge which is manufactured with the test print available is packed and distributed without any additional sealing process, the developer in the developing chamber may leak and cause contamination during a distribution process. The leakage of the developer mainly occurs between a layer regulating member, which is sealed weak, and a developing roller, between the layer regulating member and a developing housing, and between the developing roller and the developing housing by a vibration or shock arising during the distribution process of the developing cartridge.

To prevent such leakage of the developer, an additional developer sealing process is required after the test print process when the developing cartridge is manufactured.

FIG. 1 is a schematic sectional view of a developing cartridge according to a conventional exemplary embodiment.

Referring to FIG. 1, a conventional developing cartridge 1 includes a developing housing 3 which accommodates therein a developer D1 in a small amount for a test print during a manufacturing process. The developing cartridge 1 includes a developing roller 4 which is installed in the developing housing 3 and forms a toner image on an image carrier, a supplying roller 5 which supplies a developer to the developing roller 4 and a layer regulating member 6 which regulates the supply amount of the developer.

The developing cartridge 1 includes a hopper housing 7 which is coupled to an installation part 3*a* formed in the developing housing 3 in a post test print process. The hopper housing 7 accommodates therein a developer D2 to be used by a user. The hopper housing 7 includes a developer discharger 7*a* which supplies the developer D2 to the inside of the developing housing 3. The developer discharger 7*a* is supplied as sealed by a hopper film D2, which is to be removed by an end user.

The conventional developing cartridge 1 stores the developer D2 as sealed by the hopper film 9 inside the hopper housing 7, and may reduce leakage of the developer D2 during the distribution process. In addition to the developing housing 3, the hopper housing 7 is provided, and a coupling process thereof is added, thereby increasing the manufacturing process and raising part costs. Further, there is an empty space inside the developing housing 3 where the test developer D1 is not filled, and the hopper housing 7 is provided separately from the developing housing 3, and a volume efficiency of the image forming apparatus in terms of filing the developer may be lowered due to a limited space.

SUMMARY

Accordingly, one or more exemplary embodiments provide a developing cartridge and an image forming apparatus employing the same which minimizes a lowering of a volume efficiency for filling a developer and a limitation in a layout configuration of a developing cartridge and prevents a leakage of the developer.

The foregoing and/or other aspects may be achieved by providing a developing cartridge of an image forming apparatus, the developing cartridge including: a developing housing which accommodates therein a developer and includes an opening through which the developer is supplied to the outside; an image carrier which is mounted in the developing housing; a developing roller which is mounted in the opening of the developing housing to face the image carrier and develops an image on the image carrier; and a sealing member which includes a sealing part partially provided between the image carrier and the developing roller in a sealing location and sealing the opening and a grip part extended from the sealing part to an outside of the developing housing.

The sealing member may be moved and mounted in the sealing location by a rotation of the image carrier while an end part of the sealing part is provided between the image carrier and the developing roller.

The sealing member may be moved and detached from the sealing location to the outside of the developing housing as the grip part is pulled and the image carrier rotates reversely.

The developing cartridge may further include a cleaning member which is provided in the opening of the developing housing and removes the developer contaminating the sealing member when the sealing member is detached.

The foregoing and/or other aspects may be achieved by providing an image forming apparatus including: a housing; a developing cartridge which is mounted in the housing according to the above aspects; a light scanning unit which forms a latent image on the image carrier; a transfer unit which transfers a toner image from the developing cartridge to a print medium; and a fusing unit which fuses an unfused toner image transferred to the print medium.

A plate surface of the sealing part may be bent at a predetermined angle with respect to a plate surface of the grip part and an end part of the sealing part may be guided inside the opening of the developing housing when the sealing member is inserted between the image carrier and the developing roller.

A bending location between the sealing part and the grip part may be about 5 to 25 mm away from a front end of the sealing part toward the grip part.

The sealing member may include an elastic film which has a front end contacting an internal wall of the developing housing and seals the developing housing by an elastic force; and a friction triggering member which is formed in at least one side of the elastic film and provided between the developing roller and the image carrier, and triggers a friction force to mount the sealing member by a friction force with at least one of the developing roller and the image carrier when the sealing member is mounted.

The friction triggering member may be formed in an area excluding a predetermined area of a front end of the elastic film.

The sealing member may be detachably mounted between the developing roller and the image carrier through an exposing path of a light scanning unit forming a latent image by scanning light to the image carrier.

The image forming apparatus may further include a cleaning member which is mounted in the opening of the developing housing and removes a developer contaminating the sealing member when the sealing member is detached.

The foregoing and/or other aspects may be achieved by providing a developing cartridge of an image forming apparatus, the developing cartridge including: a developing housing which accommodates therein a developer, and includes an opening to supply the developer to the outside; an image carrier which is mounted in the developing housing; a developing roller which is mounted in the opening of the developing housing to face the image carrier and forms an image on the image carrier; and a sealing member which includes a sealing part partially inserted between the developing roller and the developing housing in a sealing location and sealing at least a part of the opening and a grip part extended from the sealing part to an outside of the developing housing.

The sealing member may include an elastic film which has a front end contacting an internal wall of the developing housing and seals the developing housing by an elastic force; and a friction triggering member which is formed in at least one side of the elastic film, and triggers a friction force to mount the sealing member by a friction force with at least one of the developing roller and the image carrier when the sealing member is mounted.

BRIEF DESCRIPTION OF THE DRAWINGS

The above and/or other aspects will become apparent and more readily appreciated from the following description of the exemplary embodiments, taken in conjunction with the accompanying drawings, in which.

DETAILED DESCRIPTION

Figure 1:
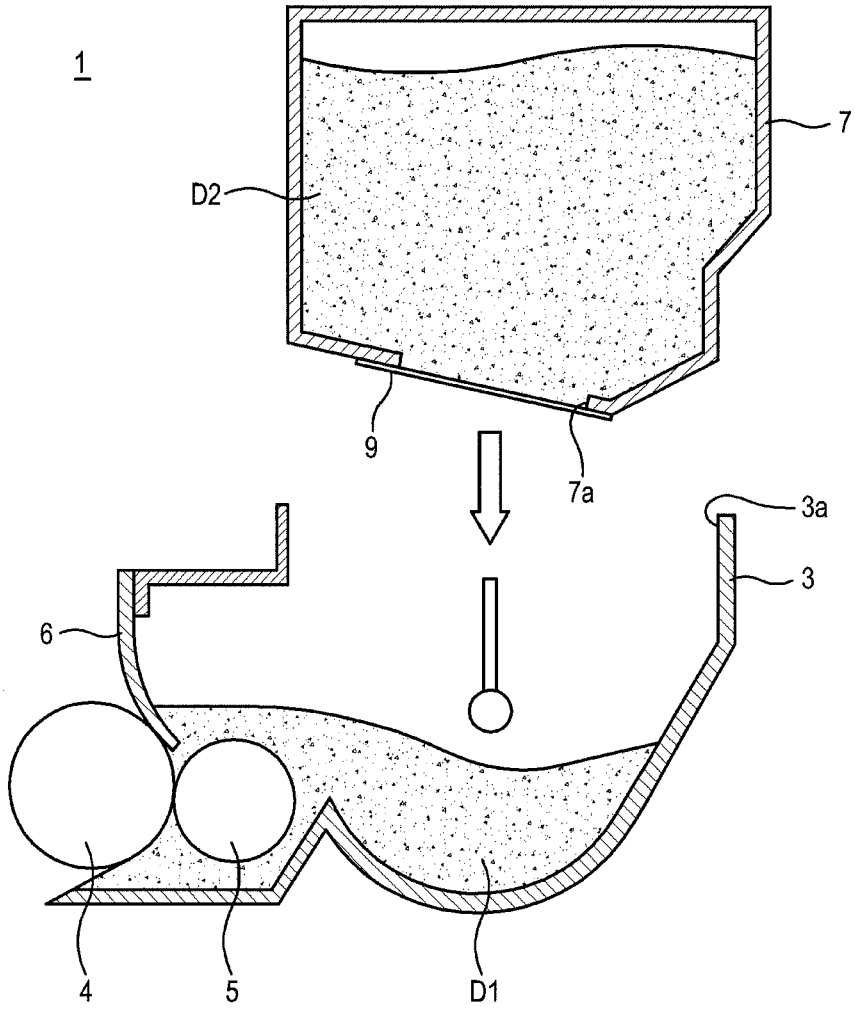
FIG. 1 is a schematic sectional view of a conventional developing cartridge.

Below, exemplary embodiments will be described in detail with reference to accompanying drawings so as to be easily realized by a person having ordinary knowledge in the art. The exemplary embodiments may be embodied in various forms without being limited to the exemplary embodiments set forth herein. Descriptions of well-known parts are omitted for clarity, and like reference numerals refer to like elements throughout.

Figure 2:
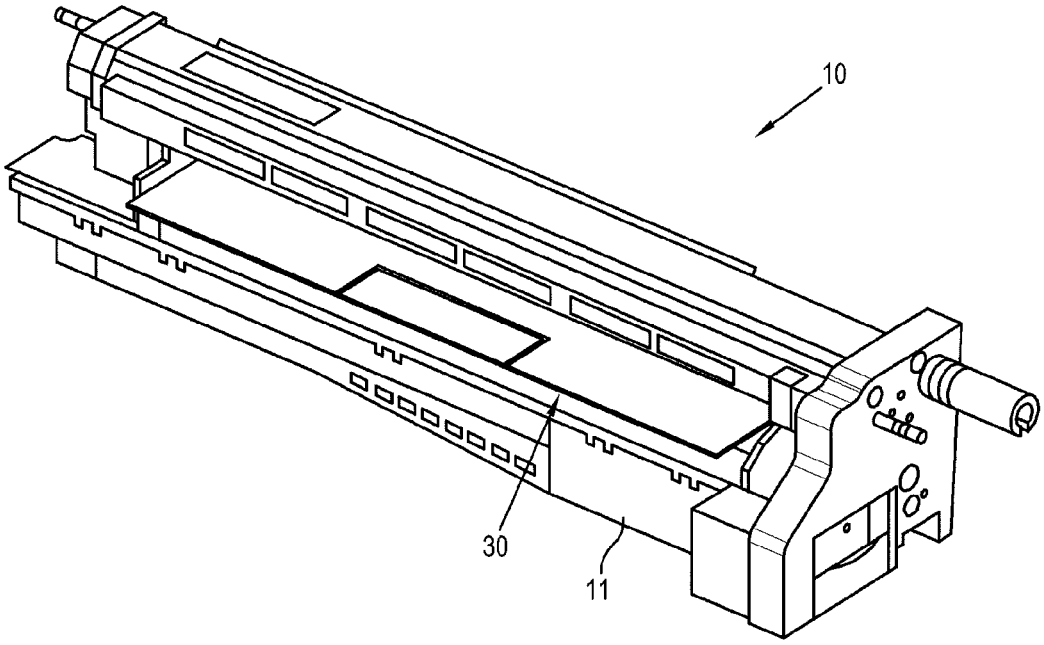
FIG. 2 is a perspective view of a developing cartridge having a sealing member mounted therein according to an exemplary embodiment.
Figure 3:
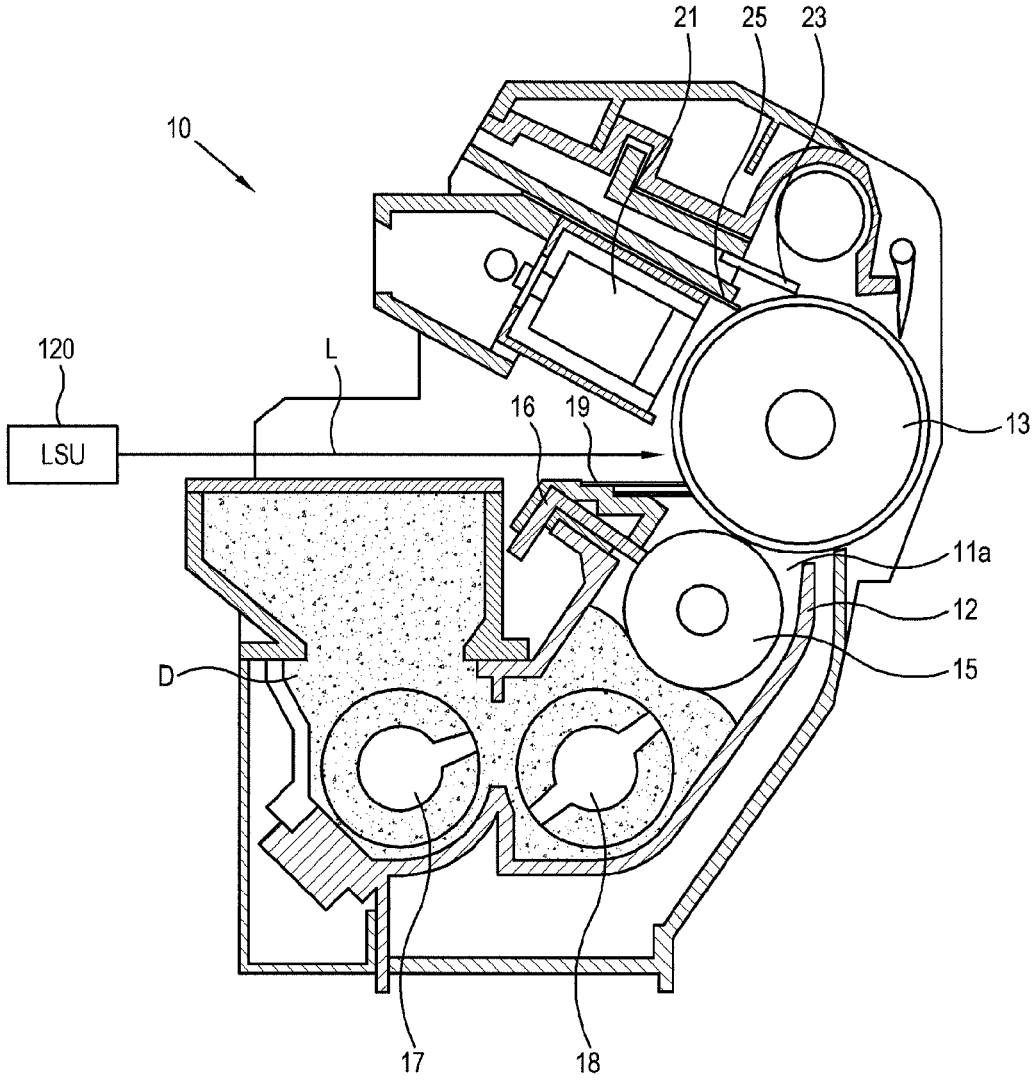
FIG. 3 is a schematic sectional view of the developing cartridge having the sealing member removed therefrom according to the exemplary embodiment.
Figure 4:
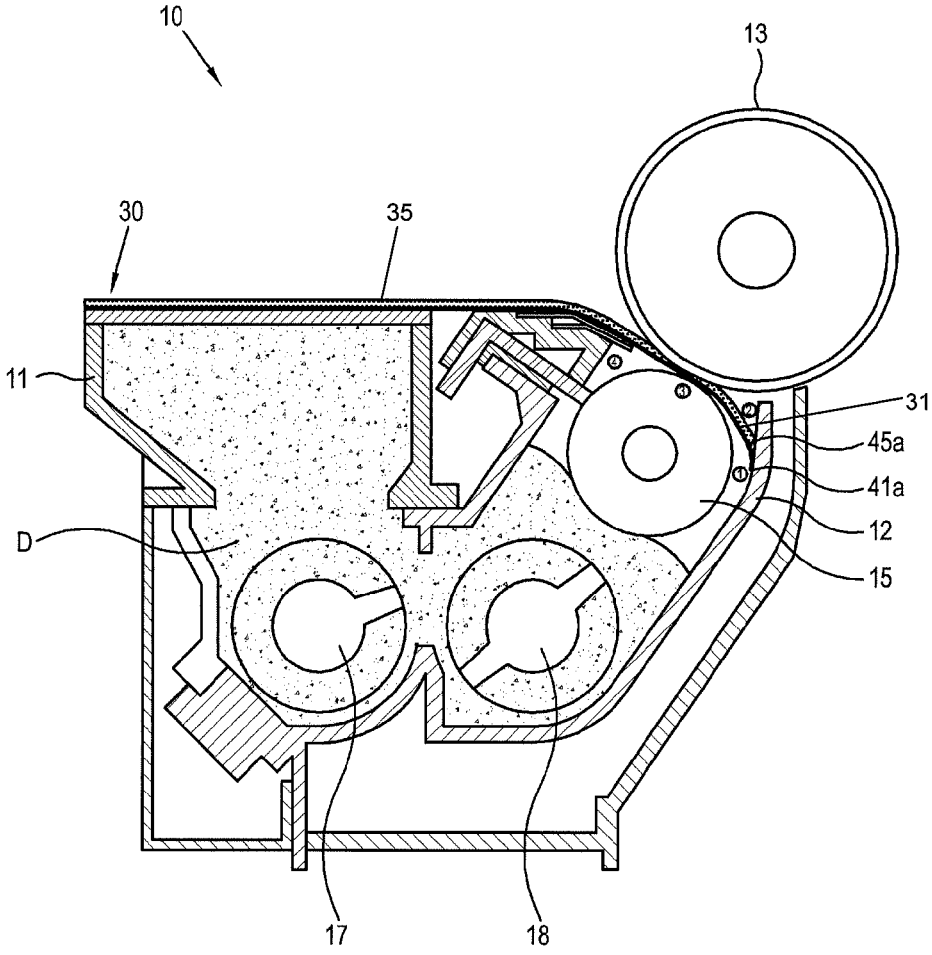
FIG. 4 is a partial sectional view of the developing cartridge having the sealing member mounted therein according to the exemplary embodiment.

FIG. 2 illustrates a perspective view of a developing cartridge according to an exemplary embodiment of the present invention. FIG. 3 illustrates a sectional view of the developing cartridge excluding a sealing member according to the exemplary embodiment. FIG. 4 illustrates a partial sectional view of the developing cartridge having the sealing member mounted therein according to the exemplary embodiment.

As shown therein, a developing cartridge 10 according to the exemplary embodiment applies to an image forming apparatus, and includes a developing housing 11, an image carrier 13, a developing roller 15 and a sealing member 30.

The developing housing 11 accommodates a developer D therein, and includes an opening 11*a* to supply the developer D to the image carrier 13. The developer D may include a two-component developer including a toner and a carrier carrying the toner by magnetism, or a developer supplying the toner without the carrier.

The image carrier 13 is rotatably mounted in the developing housing 11, and an image is formed on a circumferential surface of the image carrier 13 by charging, exposing and developing processes. For the performance of the foregoing operation, a charger 21 which charges the image carrier 13 by a predetermined electric potential, a light scanning unit (LSU) 120 which forms a latent image by scanning light to the circumferential surface of the charged image carrier 13, and a developing roller 15 which develops a toner image by supplying the developer D are provided around the image carrier 13.

Further, a cleaning member 23 which cleans a toner remained in the image carrier 13 after a transfer process and a discharging member 25 which discharges the image carrier 13 may be provided around the image carrier 13.

The developing roller 15 is provided to face the image carrier 13 within the opening 11*a* of the developing housing 11, and forms a toner image corresponding to a latent image on the image carrier 13 by receiving a predetermined developing electric potential. In the developing housing 11, a regulating blade 16 which regulates a thickness of the developer D formed on a surface of the developing roller 15 during a developing process, an agitator which agitates the accommodated developer D, and a supplying roller 18 which supplies the agitated developer D to the developing roller 15 are provided.

The sealing member 30 is mounted in the developing cartridge 10 during a post-test print assembly process and seals the opening 11*a* of the developing housing 11 in the manufacturing process of the developing cartridge 10. The sealing member 30 is removed from the developing cartridge 10 before the developing cartridge 10 is mounted in the image forming apparatus.

Figure 5:
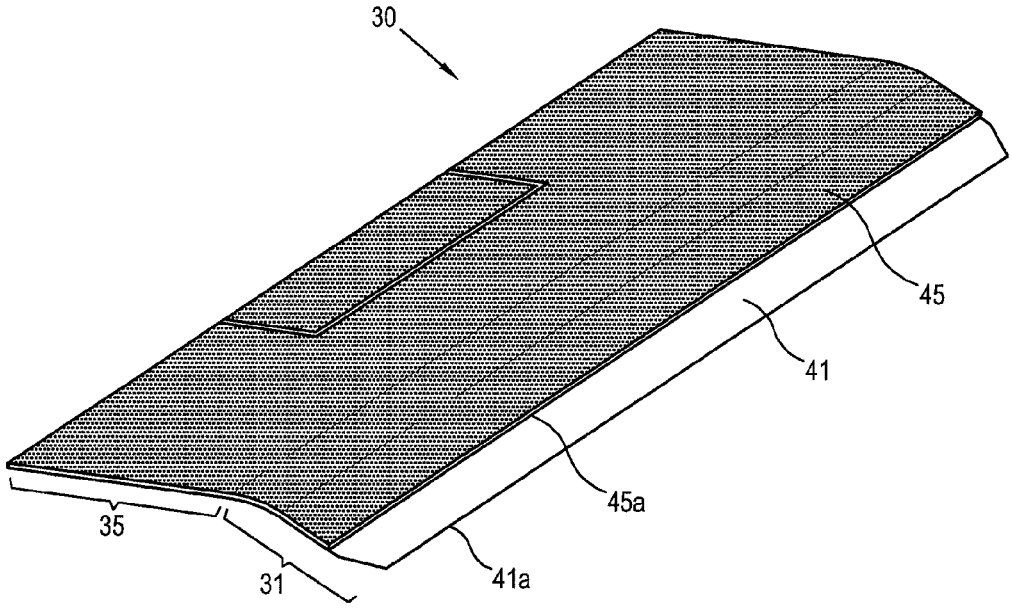
FIG. 5 is a perspective view of the developing cartridge having the sealing member according to the exemplary embodiment.
Figure 6:
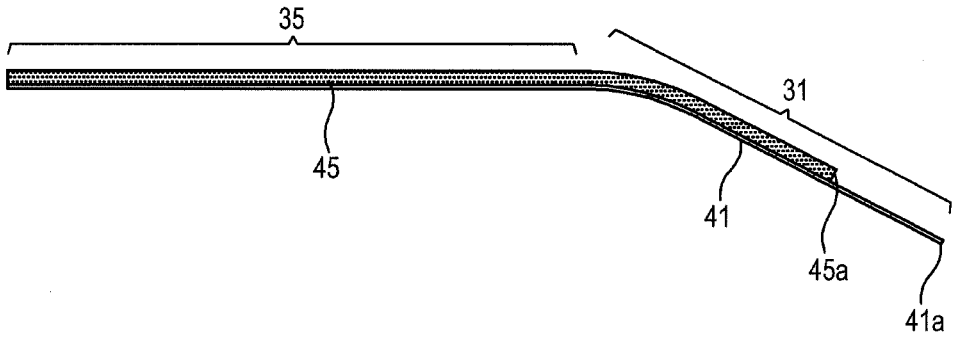
FIG. 6 is a sectional view of the developing cartridge having the sealing member according to the exemplary embodiment.

Returning to FIGS. 5 and 6, the sealing member 30 is divided into a sealing part 31 which seals the opening 11*a*, and a grip part 35 which is exposed to the outside of the developing housing 11 by which the sealing member 30 is detachably attached to the developing cartridge 10, depending on functions.

Referring to FIG. 4, the sealing part 31 is partially provided between the image carrier 13 and the developing roller 15 in a mounting completion location (the location where the sealing member 30 is mounted as in FIG. 4; hereinafter, to be called "sealing location"), and seals the opening 11*a* entirely. The grip part 35 is extended from the sealing part 31 to an outside of the developing housing 11, and used when the sealing member 30 is inserted and removed.

In the sealing member 30, a plate surface of the sealing part 31 is bent at a predetermined angle with respect to a plate surface of the grip part 35 to be mounted easily in the sealing location. When the sealing member 30 is inserted into between the image carrier 13 and the developing roller 15, a front end of the sealing part 31 is easily guided to the inside of the developing housing 11 along a wall 12 of the developing housing 11.

A bending location between the sealing part 31 and the grip part 35 is determined in consideration of the size and shape of the developing cartridge 10, and insertion direction and angle of the sealing member 30. For example, the bending location may be formed about 5 to 25 mm away from the location of the front end of the sealing part 31 toward the grip part 35.

The sealing member 30 may include an elastic film 41 and a friction triggering member 45 to improve mounting and sealing performance.

The elastic film 41 is provided across the opening 11*a* from the sealing location and prevents the developer D from leaking. For the performance of the foregoing operation, the elastic film 41 is partially provided between the developing roller 15 and the image carrier 13, and has an end part contacting the wall 12 of the developing housing 11 and is elastically deformed. By an elastic force of the elastic film 41, a gap between the end part of the elastic film 41 and the wall 12 is prevented from being formed.

The friction triggering member 45 is formed on the elastic film 41, and is detachably mounted through the developing roller 15 and the image carrier 13. The friction triggering member 45 triggers a friction force so that the sealing member 30 is mounted in the sealing location by the friction force between the friction triggering member 45 and the image carrier 13 when the image carrier 13 is rotated in a right direction to mount the sealing member 30 in the developing cartridge 10.

A first end of the friction triggering member 45 contacts the wall 12 of the developing housing 11, and assists the elastic film 41 to secondarily block the developer D from leaking to the outside of the developing housing 11. As shown in FIG. 4, the friction triggering member 45 may be formed in an entire area facing the elastic film 41 excluding a predetermined area of a front end 41*a* of the elastic film 41 so that the front end 41*a* of the elastic film 41 does not disturb the elastic contact to the wall 12 of the developing housing 11.

As described above, if the sealing member 30 is provided in the opening 11*a* of the developing housing 11, an effective sealing to developer leaking paths ①, ②, ③ and ④ in a location in FIG. 4 is possible.

The developer leaking path ① is a path along which the developer D leaks from a gap between the developing roller 15 and the developing housing 11, and the front end 41*a* of the elastic film 41 elastically contacts the wall 12 of the developing housing 11 and fills the gap between the developing roller 15 and the developing housing 11. Thus, the elastic member 41 may prevent the leakage of the developer from the gap between the developing roller 15 and the developing housing 11.

The developer leaking path ② is a path along which a fine developer leaks from the developer leakage path 1, and the front end 45*a* of the friction triggering member 45 is pressed to the wall 12 of the developing housing 11 and secondarily prevents the leakage of the fine developer.

The developer leakage path ③ is a path along which the developer leaks through a developing gap after passed between the front end 41*a* of the elastic member 41 and the wall 12, and between the front end 45*a* of the friction triggering member 45 and the wall 12. The developer which leaks from the developer leakage path 3 is blocked by the sealing member 30 pressedly provided between the image carrier 13 and the developing roller 15.

The developer leakage path ④ is a path along which the developer leaks from a gap between the developing roller 15 and the regulating blade 16, and the elastic film 41 of the sealing member 30 adheres to the developing housing 11 and forms a blocking wall to thereby block the leakage of the developer.

According to the present exemplary embodiment, the friction triggering member 45 is formed in the surface of the elastic member 41 facing the image carrier 13 and guides the mounting of the sealing member 30 by the friction force with the image carrier 13, but the present invention is not limited thereto. Alternatively, the friction triggering member 45 may be formed on both sides of the elastic film 41 and guide the sealing member 30 to be detachably mounted by the friction force between the friction triggering member 45 and the image carrier 13 and between the friction triggering member 45 and the developing roller 15. Further, the friction triggering member 45 may be formed in a surface facing the developing roller 15 and guide the sealing member 30 to be detachably mounted in the developing cartridge 10 by the friction force between the friction triggering member 45 and the developing roller 15.

The sealing member 30 may be detachably mounted between the developing roller 15 and the image carrier 13 through an exposing path L of a light scanning unit (LSU) 120 forming a latent image by scanning light to the image carrier 13. Thus, it is not necessary to secure an additional space or change a layout for detachably mounting the sealing member 30.

Figure 7A:
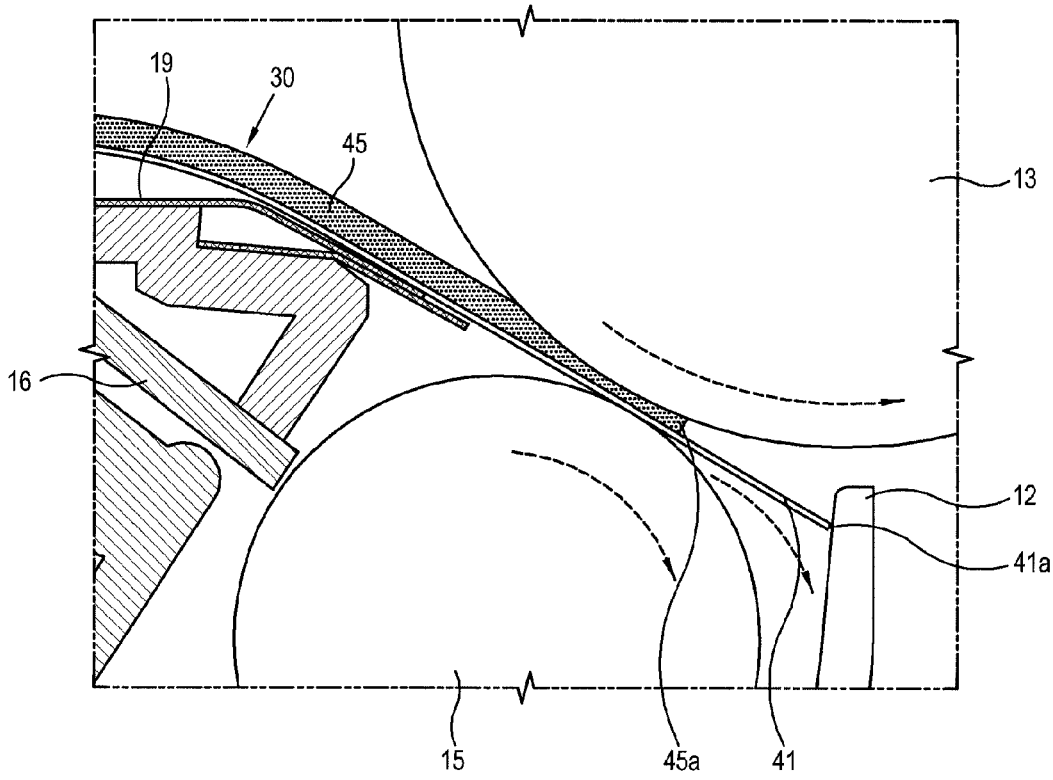
FIGS. 7A and 7B illustrate a sealing member mounting process of the developing cartridge according to the exemplary embodiment.
Figure 7B:
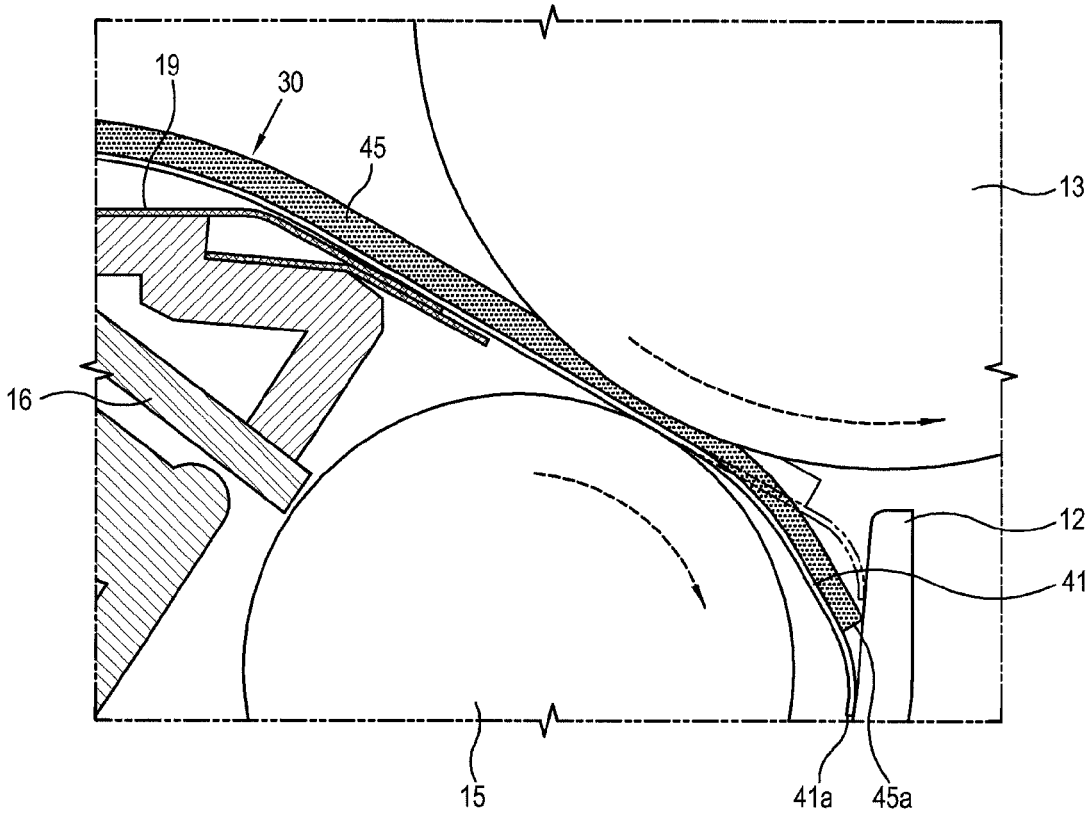

Referring to FIGS. 7A and 7B, a process of mounting the sealing member 30 of the developing cartridge 10 according to the exemplary embodiment will be described in more detail.

Referring to FIG. 7A, the mounting operation of the sealing member 30 is initiated through the exposing path L of the LSU 120 (shown in FIG. 3) while the front end 41*a* of the elastic film 41 in which the friction triggering member 45 is not formed is inserted between the image carrier 13 and the developing roller 15.

The front end 41*a* of the elastic film 41 passes through a developing gap between the image carrier 13 and the developing roller 15, and contacts the inside of the wall 12 of the developing housing 11 and stops its movement. The front end 45*a* of the friction triggering member 45 is pressed between the image carrier 13 and the developing roller 15. The thickness of the friction triggering member 45 may be adjusted in consideration of the developing gap. For example, the friction triggering member 45 may be the same or larger than the developing gap in thickness, and the sealing member 30 may move in a mounting and detaching direction by the friction force when the image carrier 13 rotates.

As described above, if the image carrier 13 rotates in the mounting direction of the sealing member 30 (counterclockwise in FIG. 7B) while the front end 45*a* of the friction triggering member 45 is pressed between the image carrier 13 and the developing roller 15, the sealing member 30 is moved to the sealing location by the friction force between the image carrier 13 and the friction triggering member 45 as shown in FIG. 7B. As the area between the sealing part 31 and the grip part 35 of the sealing member 30 is bent, the sealing member 30 initiates its movement while slantly contacting the wall 12 of the developing housing 11. By even a small rotational driving force of the image carrier 13, the sealing member 30 is inserted into the mounting location without difficulty. As expressed in dotted line in FIG. 7B, the front end 45*a* of the friction triggering member 45 contacts the wall 12 and the sealing member 30 suspends its movement and the mounting of the sealing member 30 to the sealing location is completed. If the gap between the front end 45*a* of the friction triggering member 45 and the front end 41*a* of the elastic film 41 is changed, the mounting depth of the sealing member 30 and the contact location of the sealing member 30 with the wall 12 may be adjusted.

As described above, if the mounting of the sealing member 30 is completed, the friction triggering member 45 is pressed between the image carrier 13 and the developing roller 15 and the location of the sealing member 30 is not moved even if a vibration and shock arises during the distribution process of the developing cartridge 10.

As described above, the developing cartridge 10 including the sealing member 30 is used by an end user after the sealing member 30 is removed. The sealing member 30 may be removed by pulling the grip part 35 of the sealing member 30 exposed to the outside in the opposite direction of the insertion direction. That is, if the sealing member 30 is pulled, the image carrier 13 rotates reversely by the friction force between the friction triggering member 45 and the image carrier 13 and the sealing member 30 moves from the sealing location and is detached out of the developing housing 11.

Then, the sealing member 30 may be contaminated by the developer D accommodated in the developing housing 11. To remove the foregoing contamination, the developing cartridge 10 according to the exemplary embodiment may further include a cleaning member 19 mounted in the opening 11*a* of the developing housing 11 or in the neighborhood of the opening 11*a* as shown in FIG. 3. FIG. 3 illustrates a pair of cleaning blades as the cleaning member 19. If the cleaning member 19 is provided as described above, a front end of the cleaning member 19 contacts the elastic film 41 of the sealing member 30. Accordingly, when the sealing member 30 is detached, the cleaning member 19 removes the developer contaminating the sealing member 30.

The front end of the cleaning member 19 is contacted the image carrier 13 after detached the sealing member 30. Thus, the cleaning member 19 forms a blocking wall to thereby block the leakage of the developer through the developer leakage path ④.

With the foregoing configuration, the developing cartridge 10 according to the exemplary embodiment of the present invention may include the sealing member 30 which is mounted and detached through the exposing path of the light scanning unit 120, and through the developing gaps between the image carrier 13 and the developing roller 15 and seals the opening 11*a* of the developing housing 11 to thereby maintain a sealing efficiency and make the entire configuration compact.

According to the exemplary embodiment, the sealing member 30 is inserted between the image carrier 13 and the developing roller 15 in the sealing location, but not limited thereto. Alternatively, a part of the sealing member 30 may be inserted between the developing roller 15 and the developing housing 11 without passing the developing gap. As a means for mounting the sealing member 30 by the friction force of the image carrier 13, a dummy pressure roller (not shown) may be temporarily installed corresponding to the image carrier 13. In this case, the image carrier 13 rotates while the front end of the sealing member 30 is inserted between the developing housing 11 and the developing roller 15 after passed through the image carrier 13 and the dummy pressure roller, and the sealing member 30 may be mounted by the friction force between the sealing member 30 and the image carrier 13.

Figure 8:
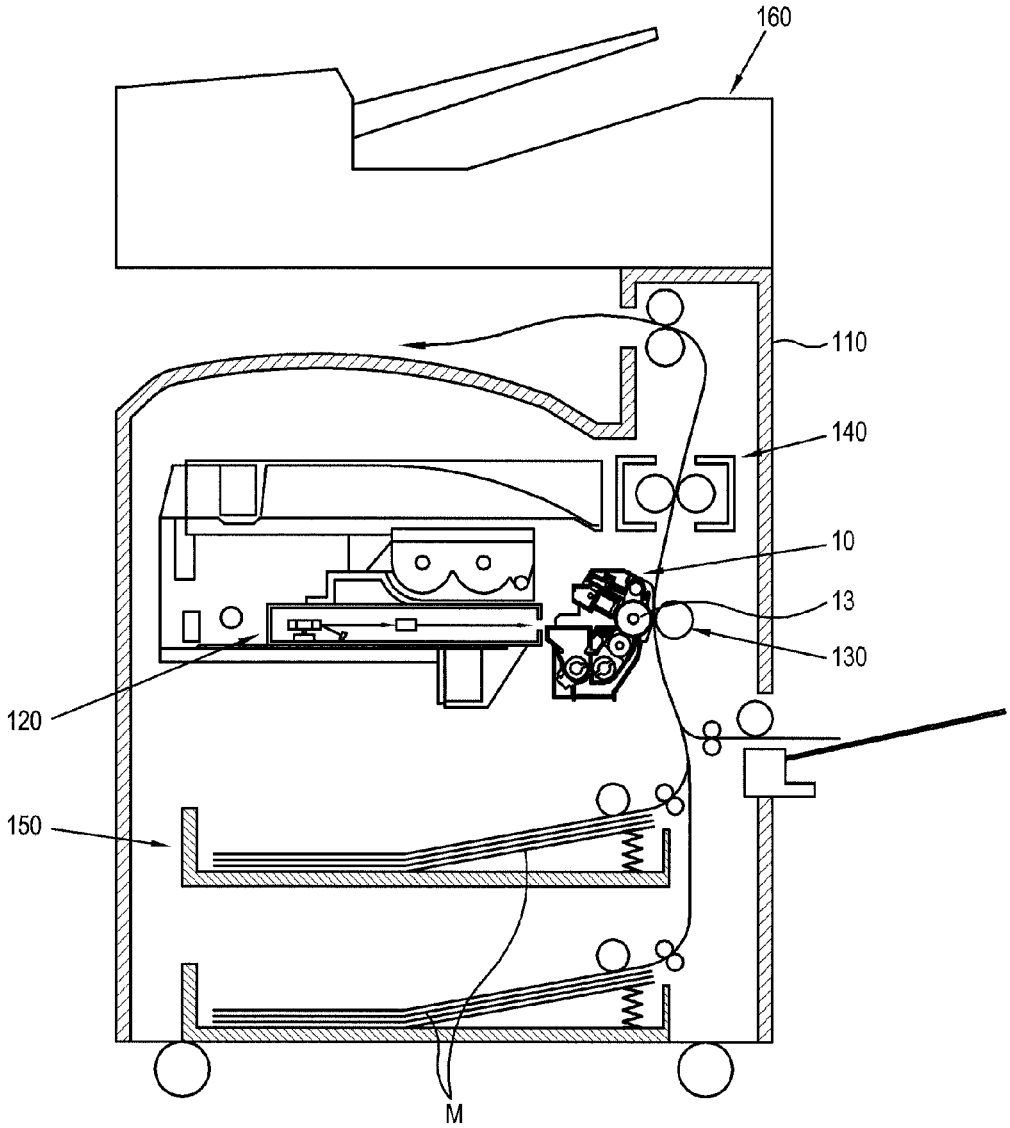
FIG. 8 is a schematic sectional view of an image forming apparatus which employs the developing cartridge according to the exemplary embodiment.

Hereinafter, the image forming apparatus according to the exemplary embodiment will be described with reference to FIG. 8.

As shown therein, the image forming apparatus according to the exemplary embodiment includes a housing 110, the developing cartridge 10 including the image carrier 13, the light scanning unit 120 forming a latent image on the image carrier 13, a transfer unit 130 transferring a toner image from the developing cartridge 10 to a print medium M, and a fusing unit 140 fusing an unfused toner image transferred to the print medium M.

The developing cartridge 10 develops the toner image with respect to the latent image formed on the image carrier 13, and is supplied with the sealing member 30 mounted therein, as described above with reference to FIGS. 2 to 7B. When the developing cartridge 10 is mounted in the image forming apparatus, the sealing member 30 is removed from the developing cartridge 10. The configuration of the developing cartridge 10 is substantially the same as that of the developing cartridge 10 according to the exemplary embodiment. Thus, the repetitive description will be avoided.

The transfer unit 130 is supplied through the supply unit 150 and faces the image carrier 13, leaving the print medium M moved through a moving path therebetween, and transfers to the print medium M the toner image formed on the image carrier 13. The fusing unit 140 fuses the unfused toner image to the print medium M by heat and pressure.

The image forming apparatus according to the present exemplary embodiment includes a mono image forming apparatus, but not limited thereto. Alternatively, the image forming apparatus may include a tandem color image forming apparatus forming a color image by single pass or multi pass. As shown in FIG. 8, the image forming apparatus may include a document reading unit 160.

With the foregoing configuration, the image forming apparatus according to the present invention employs the developing cartridge including a simplified sealing configuration, and minimizes a limitation of a layout configuration according to the developer sealing configuration.

With the foregoing configuration, the image forming apparatus according to the present invention employs the sealing member which seals the opening of the developing housing by the rotation of the image carrier, and minimizes the lowering of the volume efficiency for filling the developer and the limitation of the layout configuration of the developing cartridge and prevents the leakage of the developer. Accordingly, the manufacturing process of the developing cartridge is simplified and costs are reduced.

The image forming apparatus according to the present invention employs the developing cartridge including the simplified sealing configuration and minimizes the limitation of the layout according to the developer sealing configuration.

Although a few exemplary embodiments have been shown and described, it will be appreciated by those skilled in the art that changes may be made in these exemplary embodiments without departing from the principles and spirit of the invention, the scope of which is defined in the appended claims and their equivalents.

What is claimed is:

1. A developing cartridge of an image forming apparatus, the developing cartridge comprising:

a developing housing which accommodates a developer and an image carrier and which comprises an internal wall in which an opening for supplying the developer to the image carrier is formed;

a developing roller which is mounted in the opening of the developing housing to face the image carrier; and a sealing member disposed between the image carrier and the developing roller to seal the opening, the sealing member comprising:

a first end for gripping; and an elastic film which is elastically deformable at a second end of the sealing member to provide an elastic force for biasing the sealing member contracting the internal wall so that formation of a gap between the internal wall and a front end of the elastic film is prevented.

2. The developing cartridge according to claim 1, wherein the sealing member further comprises:

a grip part provided to the first end so as to protrude from the developing housing when the sealing member is inserted between the image carrier and the developing roller; and a sealing part provided to the second end, which is guided inside the opening during insertion.

3. The developing cartridge according to claim 2, wherein the grip part and the sealing part form a predetermined angle at a bending location occurring about 5 to 25 mm from a front edge of the sealing part toward the grip part.

4. The developing cartridge according to claim 1, wherein the sealing member further comprises:

a friction triggering member which is formed on at least one side of the elastic film and is provided between the developing roller and the image carrier to trigger a friction force with respect to at least one of the developing roller and the image carrier in order to mount the sealing member in a sealing location.

5. The developing cartridge according to claim 4, wherein the friction triggering member is formed in an area excluding a predetermined area of the front end of the elastic film.

6. The developing cartridge according to claim 1, wherein the sealing member is detachably mounted in a sealing location between the developing roller and the image carrier through an exposing path of a light scanning unit which forms a latent image by scanning light to the image carrier.

7. The developing cartridge according to claim 6, wherein the sealing member is mounted in the sealing location by a rotation of the image carrier while the second end of the sealing member is provided between the image carrier and the developing roller.

8. The developing cartridge according to claim 6, wherein the sealing member is detached from the sealing location as the first end of the sealing member is pulled and the image carrier rotates reversely.

9. The developing cartridge according to claim 6, further comprising:

a cleaning member which is provided in the opening of the developing housing to remove contaminating developer from the sealing member when the sealing member is detached.

10. The developing cartridge according to claim 9, wherein the cleaning member comprises a pair of cleaning blades.

11. An image forming apparatus comprising:

a housing in which the developing cartridge according to claim 1 is mounted;

a light scanning unit which forms a latent image on the image carrier;

a transfer unit which transfers a toner image from the developing cartridge to a print medium; and a fusing unit which fuses an unfused toner image transferred to the print medium.

12. The image forming apparatus according to claim 11, wherein the sealing member further comprises:

a grip part provided to the first end so as to protrude from the developing housing when the sealing member is inserted between the image carrier and the developing roller; and a sealing part provided to the second end, which is guided inside the opening during insertion.

13. The image forming apparatus according to claim 12, wherein the grip part and the sealing part form a predetermined angle at a bending location occurring about 5 to 25 mm from a front edge of the sealing part toward the grip part.

14. The image forming apparatus according to claim 11, wherein the sealing member further comprises:

a friction triggering member which is formed on at least one side of the elastic film and is provided between the developing roller and the image carrier to trigger a friction force with respect to at least one of the developing roller and the image carrier in order to mount the sealing member in a sealing location.

15. The image forming apparatus according to claim 14, wherein the friction triggering member is formed in an area excluding a predetermined area of the front end of the elastic film.

16. The image forming apparatus according to claim 11, wherein the sealing member is detachably mounted in a sealing location between the developing roller and the image carrier through an exposing path of a light scanning unit forming a latent image by scanning light to the image carrier.

17. The image forming apparatus according to claim 16, further comprising:

a cleaning member which is mounted in the opening of the developing housing to remove contaminating developer from the sealing member when the sealing member is detached.

18. A developing cartridge of an image forming apparatus, the developing cartridge comprising:

a developing housing which accommodates a developer and an image carrier and which comprises an internal wall in which an opening for supplying the developer to the image carrier is formed;

a developing roller which is mounted in the opening of the developing housing to face the image carrier; and a sealing member to seal the opening when partially inserted between the developing roller and the developing housing in a sealing location, the sealing member comprising:

a first end for gripping; and an elastic film which is elastically deformable at a second end of the sealing member to provide an elastic force for biasing the sealing member against the internal wall so that formation of a gap between the internal wall and a front end of the elastic film is prevented.

19. The developing cartridge according to claim 18, wherein the sealing member further comprises:

a friction triggering member which is formed on at least one side of the elastic film to trigger a friction force with respect to at least one of the developing roller and the image carrier in order to mount the sealing member in the sealing location.

20. The developing cartridge according to claim 18, wherein the sealing member is mounted in the sealing location by a rotation of the image carrier while the second end of the sealing member is provided between the developing housing and the developing roller.

21. A sealing member for a developing cartridge of an image forming apparatus, the sealing member comprising:

an elastic film which has a front end contacting an internal wall which is elastically deformable to provide an elastic force for biasing the sealing member against the internal wall of a developing housing to seal an opening formed in the internal wall; and a friction triggering member which is formed on at least one side of the elastic film and is provided between a developing roller and an image carrier to trigger a friction force with respect to at least one of the developing roller and the image carrier in order to mount the sealing member in a sealing location.

22. The sealing member according to claim 21, wherein the elastic film generates an elastic force by elastically deforming the front end of the elastic film to bias the elastic film against the internal wall so that formation of a gap between the internal wall and the elastic film is prevented.

* * * * *